US010092076B2

(12) United States Patent
Mandica et al.

(10) Patent No.: US 10,092,076 B2
(45) Date of Patent: Oct. 9, 2018

(54) HAIRSTYLING APPLIANCE

(71) Applicant: SEB S.A., Ecully (FR)

(72) Inventors: Franck Mandica, Francheville (FR); Regis Fereyre, Chavanay (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 14/387,037

(22) PCT Filed: Mar. 18, 2013

(86) PCT No.: PCT/FR2013/050565
§ 371 (c)(1),
(2) Date: Sep. 22, 2014

(87) PCT Pub. No.: WO2013/140073
PCT Pub. Date: Sep. 26, 2013

(65) Prior Publication Data

US 2015/0047667 A1 Feb. 19, 2015

(30) Foreign Application Priority Data

Mar. 20, 2012 (FR) ..... 12 52582

(51) Int. Cl.
*A45D 2/00* (2006.01)
*A45D 1/04* (2006.01)
*A45D 7/02* (2006.01)

(52) U.S. Cl.
CPC ..... *A45D 2/001* (2013.01); *A45D 1/04* (2013.01); *A45D 7/02* (2013.01)

(58) Field of Classification Search
CPC ..... A45D 1/001; A45D 1/08; A45D 1/10
See application file for complete search history.

(56) References Cited

U.S. PATENT DOCUMENTS 4,591,695 A * 5/1986 Inoue ..... A45D 1/04 132/232
2004/0163661 A1* 8/2004 Carlucci ..... A45D 1/04 132/222

(Continued)

FOREIGN PATENT DOCUMENTS

EP 2204104 * 7/2010
EP 2204104 A1 7/2010

(Continued)

OTHER PUBLICATIONS

Machine Translation of Keisuke et al. reference.*
Machine Translation of Koyama reference.*
Keisuke et al. images.*

*Primary Examiner* — Cris L Rodriguez
*Assistant Examiner* — Brianne Kalach
(74) *Attorney, Agent, or Firm* — The Webb Law Firm

(57) ABSTRACT

Provided is a hairstyling appliance for styling hair, comprising a first housing and a second housing facing the first housing; the housings, of longitudinal axis, being connected in a pivoting manner by a hinge so as to define an open and closed position of the appliance; the first housing having a first hair treatment surface which is intended to be heated by a first heating means; the second housing having at least one second hair treatment surface which is intended to come into contact with the first surface in order to grip the hair in the closed position; the appliance containing two cylinders arranged on each side of one of the treatment surfaces, the cylinders being mounted so as to be able to rotate about their longitudinal axis.

17 Claims, 4 Drawing Sheets

(56) References Cited

U.S. PATENT DOCUMENTS

| | | | | |
|---|---|---|---|---|
| 2006/0278251 | A1* | 12/2006 | Hur | A45D 1/04 132/232 |
| 2010/0170883 | A1* | 7/2010 | Legrain et al. | 219/225 |

FOREIGN PATENT DOCUMENTS

| | | | | |
|---|---|---|---|---|
| EP | 2386219 | A1 | | 11/2011 |
| JP | 63-125901 | | * | 8/1988 |
| JP | 2001104036 | | * | 4/2001 |
| JP | 2001104036 | A | | 4/2001 |
| JP | 2005237803 | | * | 9/2005 |
| KR | 2010124022 | | * | 11/2010 |

* cited by examiner

HAIRSTYLING APPLIANCE

CROSS-REFERENCE TO RELATED APPLICATIONS

This application is the United States national phase of International Application No. PCT/FR2013/050565 filed Mar. 18, 2013, and claims priority to French Patent Application No. 12 52582 filed Mar. 22, 2012, the disclosures of which are hereby incorporated in their entirety by reference.

TECHNICAL FIELD OF THE INVENTION

The present invention relates to an appliance for dressing or styling hair, more particularly to an electric straightening iron or electric curling iron or electric root lift appliance, for styling hair by any type of heat.

DESCRIPTION OF THE PRIOR ART

Most hairstyling appliances such as, for example, straightening irons and crimping or curling irons, comprise two hot or heated treatment surfaces that grip a lock of hair by switching from an open position allowing the insertion of the hair to a closed position for bringing it in contact between the two surfaces.

The aim of all of these hairstyling devices is to ensure good styling without, however, applying excessive traction to the lock of hair, notably traction applied by the lateral edges of the treatment surfaces as the treatment surfaces are moved along the lock of hair.

Several solutions have been conceived for reducing the traction exerted on the hair by the lateral edges of the treatment surfaces.

A first type of solution relates notably to plates mounted so as to be able to move, for instance on springs, rockers, etc. A second type of solution relates to the arrangement and the shape of the treatment plates. As a rule the treatment plate protrudes relative to the housing and its lateral edges are angular and apply unwanted traction to the hair. The solution adopted is to give the lateral edge a rounded shape for reducing the traction.

In practice, however, these solutions are not sufficiently effective and do not sufficiently reduce the traction applied by the edges of the treatment surfaces, and the hair is still damaged. Furthermore, the user must apply a certain effort to keep the straightener gripping the hair in the closed position and to slide it along the lock. Hence the prior art appliances neither address nor solve the following problem: combining efficacy in styling by the treatment surfaces with minimum traction on the hair.

PRESENTATION OF THE INVENTION

The object of the present invention is to provide an electric hairstyling appliance having at least one heating treatment surface the styling of which is effective and which applies minimum traction to the hair.

Another object of the present invention is to enable straightening over essentially the entire length of the lock without the risk of damaging the hair.

Another object of the present invention is to create root lift and give volume to the hair without the risk of damaging it.

Another object of the invention is to provide a hairstyling appliance capable of styling hair in a rapid and effective manner.

Another object of the invention is to provide a hairstyling appliance capable of creating a hair style that lasts for a prolonged period.

Another object of the invention is to provide a hairstyling appliance capable of applying a cosmetic simultaneously with the styling.

Another object of the invention is to provide a hairstyling appliance capable of improving the heat transfer with a lock of hair to be treated.

Another object of the invention is to provide a hairstyling appliance capable of ensuring good ergonomics and comfortable use along with reliable operation.

Another object of the invention is to provide a hairstyling appliance of simplified, compact construction and capable of being mass produced at low cost.

Another object of the invention is to provide a hairstyling appliance capable of providing the heat in a safe or protective manner to the hair without the risk of burning the hair and/or the scalp.

Another object of the invention is to manufacture an appliance capable of providing a temperature suitable to the type of hair, for example fine, thick, dense or thin hair.

Another object of the invention is to provide a hairstyling appliance that allows effective treatment of the hair and which is easy and practical to use.

These objects are achieved with a hairstyling appliance for styling hair comprising a first housing and a second housing facing the first housing, the housings of longitudinal axis being connected in a pivoting manner by a hinge so as to define an open and closed position of the appliance; the first housing having a first hair treatment surface which is intended to be heated by a first heating means; the second housing having at least one second hair treatment surface which is intended to come into contact with the first surface in order to grip the hair in the closed position; the appliance containing just two cylinders arranged on each side of one of the treatment surfaces, the cylinders being mounted so as to be able to rotate about their longitudinal axis. Hence as the user slides the appliance along the treated lock, the cylinders each roll upstream and downstream of the treatment surfaces and avoid applying significant traction to the lock. The fact that the cylinders are freely rotating and therefore easily "drivable" by the passage of the lock of hair keeps the hair from rubbing against the housing or against the sides of the treatment surface. The cylinders are drivable in rotation solely by the displacement of the appliance along the hair. Furthermore, the radius formed by the cylinders makes it possible to reduce the hair "marking" phenomenon considerably. The cylinders are essentially identical.

According to the invention, both cylinders are mounted so as to be able to rotate freely about their respective longitudinal axis. They therefore turn according to the direction and the speed of the movement of the appliance along the lock.

According to the invention, the longitudinal axes of both cylinders can be parallel. This makes it possible to apply a reduced traction in a symmetrical manner on each side of the hair treatment surface.

According to the invention, the two cylinders can be arranged directly adjacent to said hair treatment surface. "Directly adjacent" means that each cylinder is near each edge of the treatment surface without another part being sandwiched between the edge and the cylinder. They are separated by a small gap necessitated by the design of the appliance.

According to the invention, the axis of both cylinders and each of the two treatment surface edges adjacent to the cylinders can be essentially coplanar. This means that in addition to being close, they are situated at essentially the same level so as not to create modifications in the styling by simply adding small cylinders.

According to the invention, the cylinders can be arranged on each side of the first treatment surface. According to a first embodiment of the invention, the second housing can therefore have its longitudinal edges arranged on each side of the second treatment surface and facing the cylinders in the closed position. This embodiment makes it possible to manufacture a compact appliance with optimum treatment surfaces.

Alternatively, according to a second embodiment of the invention, the second housing can comprise two troughs, which are each arranged on each side of the second treatment surface such that, in the closed position, each one holds a cylinder. This embodiment makes it possible to manufacture a symmetrical appliance with essentially identical treatment surfaces.

Alternatively, according to a third embodiment of the invention, the second housing covers just the first treatment surface. This embodiment makes it possible to manufacture a compact appliance with essentially identical treatment surfaces.

According to the invention, the second treatment surface can be essentially cylindrical and the first treatment surface can have the shape of a tile covering, in the closed position, the second treatment surface along an axis of overlap of 160° to 190°, preferably approximately equal to 180°. This corresponding shape configuration makes it possible to create a wave at a selected location on the lock, for example at the root of the lock. The hair treatment zone defined in the closed position by the gripping of the two surfaces on the lock can be non-planar, for example curved, preferably arched. The two mini-rollers adjacent to the treatment zone are arranged on the selected jaw such that the lateral edges of this zone do not leave marks on the lock due to the passage of the appliance along the lock.

According to the invention, the second treatment surface can be formed by a cylinder attached to the second housing and able to rotate about its longitudinal axis.

According to the invention, both treatment surfaces can be flat straightening surfaces.

According to the invention, the cylinders have a diameter of 3 to 6 mm, preferably 4 to 5 mm. The relative ratio between the diameter of the small cylinders and the gap between these two cylinders is 1/3 to 1/5, preferable equal to around 1/4. The diameter of the cylinders is relatively small compared to the gap between the two cylinders provided for the treatment surface. If the gap is occupied by a straightening plate, then the width of the plate is around 25 mm. If the gap is occupied by a half-cylinder or a cylinder, then the diameter of the latter is around 19 mm.

According to the invention, the cylinders can be made of metal or plastic. Any material resistant to a temperature above ca. 50° C. is suitable. The shape and the material are selected so as to render the surface of the cylinder as smooth as possible.

In a particular embodiment of the invention, the rollers can have spikes that can be arranged in longitudinal rows, overlapped or not, and/or bristles in order to help spread the hair in a uniform manner.

In a particular embodiment of the invention, the rollers can be heated by conduction using at least the energy from the adjacent heating element. The element can be the treatment surface arranged between the two rollers, alternatively or additionally it can be the treatment surface arranged on the other arm of the appliance, with conduction via the treatment surface between the two rollers.

In a particular embodiment of the invention, the rollers can be vibratory in order to help comb the hair and remove any tangles.

According to the invention, the cylinders can be covered with a porous material saturated with a liquid cosmetic agent or covered with a solid cosmetic agent that can be deposited by liquefying or by rubbing on the hair. This allows a cosmetic application at the same time as the straightening of the lock. The rollers can consist of a cosmetic in solid form, which can be liquefied under the effect of the heat of the appliance or deposited by contact or even by rubbing on the hair.

According to the invention, the second treatment surface can be designed to be heated by a second heating means.

The invention also relates to a method for using the appliance of the invention, comprising the following steps:

a.) Applying the appliance to the root of a lock of hair and gripping it statically for several seconds, b.) then pivoting the appliance about its longitudinal axis (L) by about a quarter of a turn downwards, c.) and then sliding the appliance along the lock all the way to the tip.

BRIEF DESCRIPTION OF THE DRAWINGS

The invention will be more clearly understood by studying modes of embodiment, which are not limiting in any way and illustrated here.

DETAILED DESCRIPTION OF THE INVENTION

Figure 1:
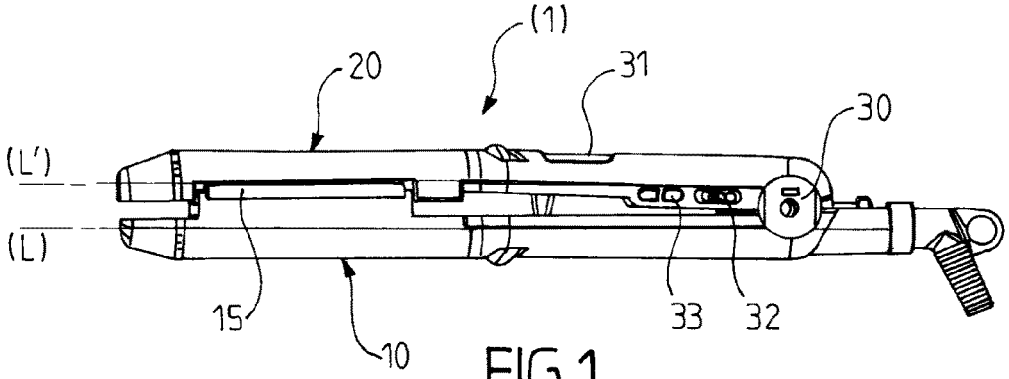
FIG. 1 shows a view of the appliance of the invention.
Figure 2:
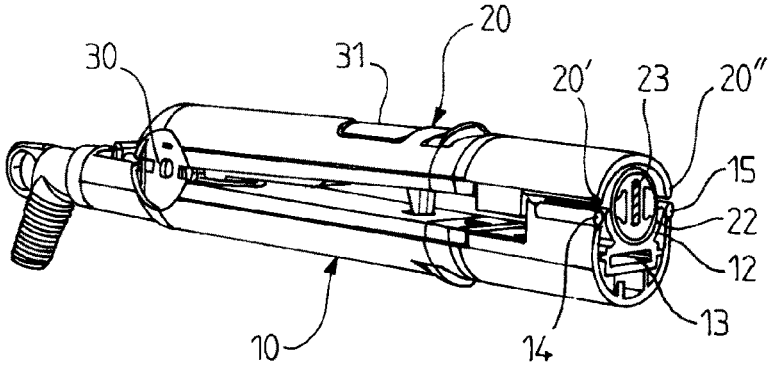
FIG. 2 shows a cross-sectional perspective view of the appliance according to a first embodiment of the invention in the closed position.

As illustrated in FIGS. 1-5, the invention relates to a heating hairstyling appliance 1 for styling hair, comprising a first housing or arm 10 defining a longitudinal axis L and a second housing or arm 20 of longitudinal axis L' facing one another and connected in a pivoting manner by a hinge 30 so as to define an open and closed position of the appliance. The first arm 10 comprises a portion defining a first treatment surface 12. Provision is made of a first heating means 13 for heating at least the first treatment surface 12 and said surface can have the shape of a treatment plate 12. The second arm 20 comprises at least one portion defining a second treatment surface 22 comprising a second heating element 23. The second treatment surface 22 is intended to come into contact with the first treatment surface 12 for receiving the hair in the closed position. The two cylinders 14, 15 are arranged on each side of one of the treatment surfaces 12, 22, the cylinders being mounted so as to be able to rotate about their longitudinal axis Δ14; Δ15. The cylinders are freely rotating, meaning that they are neither motorized nor clamped in an immobile manner. Their longitudinal axis is parallel to the longitudinal axis of the arm supporting them. The cylinder can be a revolving cylinder. Just two cylinders 14, 15 capable of rotating are provided on one arm, without the arrangement of other movable cylinders facing them: the principle is that the lock of hair is in contact with one cylinder at a time, which rolls along the lock. The lock is not arranged in contact between two cylinders in movement and in contact.

The first heating means 13, just like the second heating means 23, can be an electrical resistor, notably a PTC resistor. Notably, such a resistor has the advantage of a low bulk for a high heating efficiency, plus it has auto-regulating heating properties. In a second alternative embodiment, the heating element 13, 23 can be a ceramic resistor or even consist of an electrically resistant flexible film. The treatment surface 12, 22 can be made of metal, for example of aluminum, or of any other material that offers a good compromise between thermal conductivity and cost. A circuit board (not shown) is held by the top cover and permits the control of the heating of the appliance. The second arm has a (e.g., digital) display 31 for displaying the set heating temperature of the plates in operation. Provision is made of a switch 32 for controlling the heating temperature.

Figure 3:
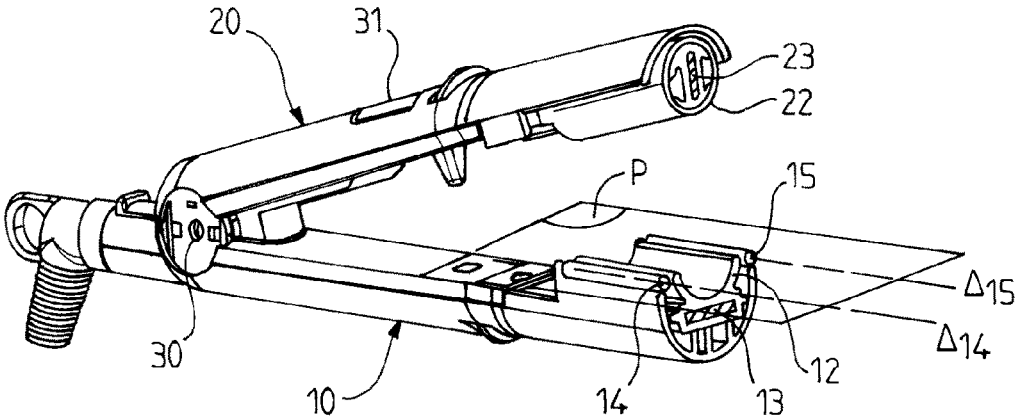
FIG. 3 shows a cross-sectional perspective view of the appliance according to a first embodiment of the invention in the open position.
Figure 4:
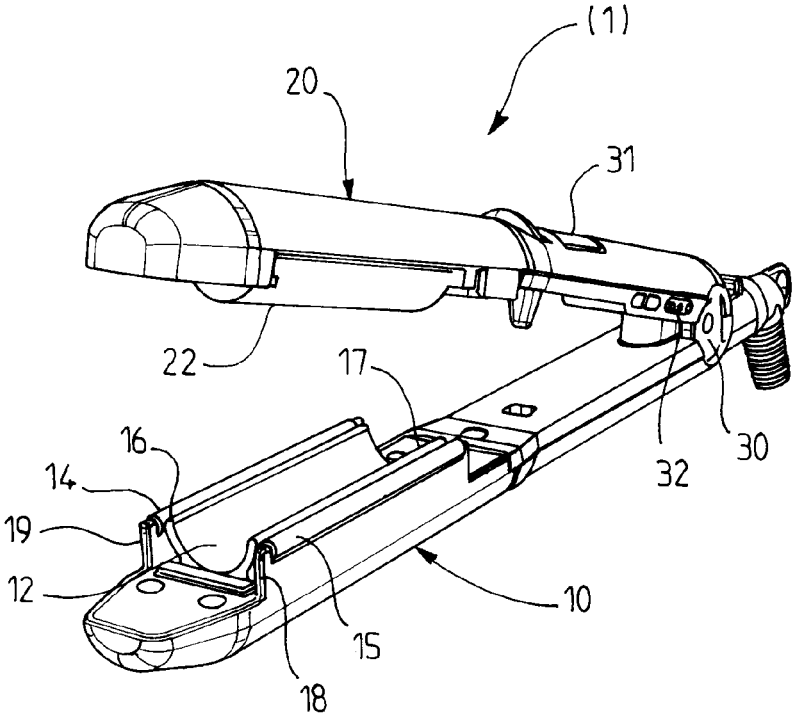
FIG. 4 shows a perspective view of the appliance according to a first embodiment of the invention in the open position.
Figure 5:
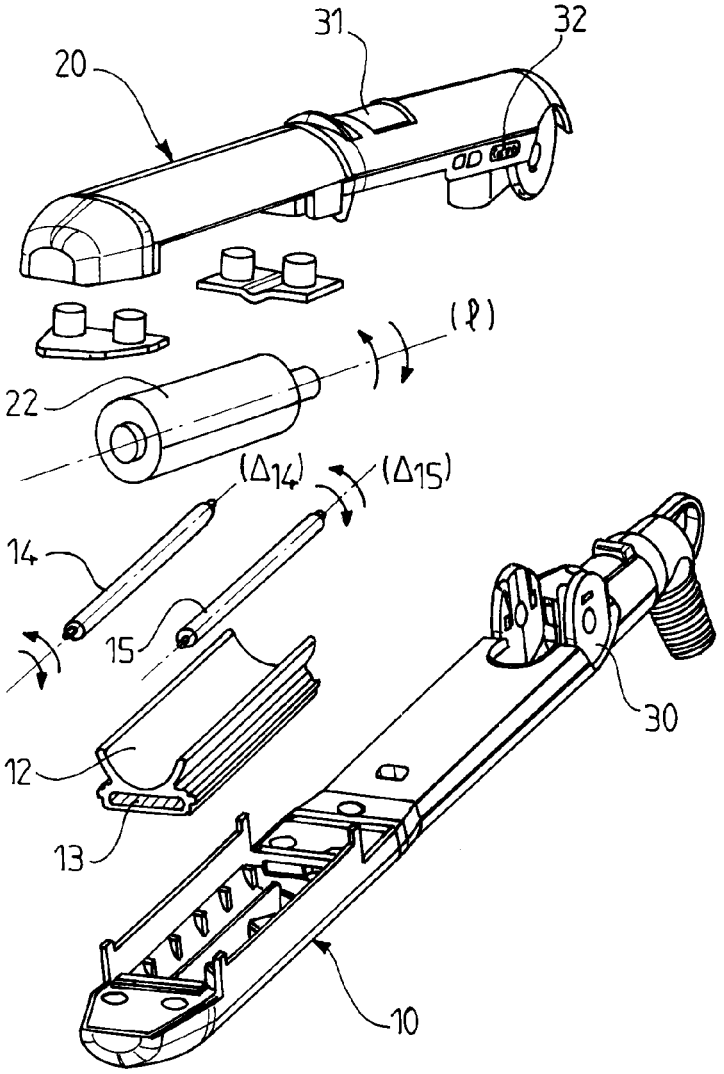
FIG. 5 shows an exploded perspective view of the appliance according to a first embodiment of the invention in the open position.

The two cylinders 14, 15 are mounted on the housing so as to be able to rotate freely about their respective longitudinal axis Δ14; Δ15 and on two extensions 18 and 19, respectively, of the arm 10. The longitudinal axes of the two cylinders 14, 15 are parallel. The two cylinders 14, 15 are arranged directly adjacent to the treatment surface 12. They are in the continuity of the treatment surface. As shown in FIG. 3, each of the axes (Δ14; Δ15) of the two cylinders 14, 15 and each of the two treatment surface edges 16, 17 adjacent to the cylinders 14, 15 are essentially coplanar in the plane P.

Figure 6:
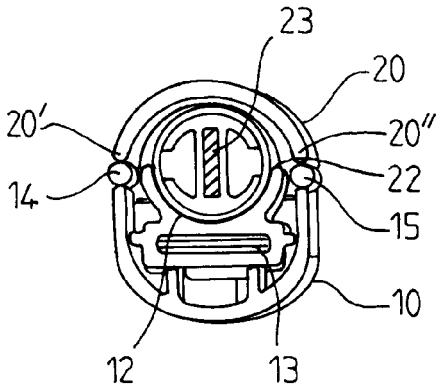
FIG. 6 shows a cutaway view of the first embodiment of the invention.
Figure 7:
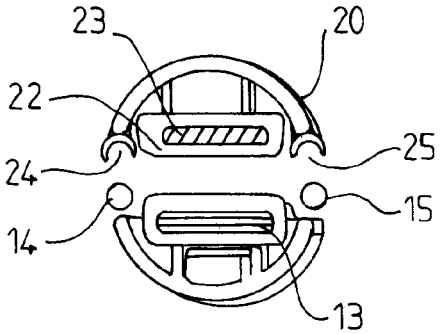
FIGS. 7 and 8 show a cutaway view of the second and the third embodiments of the invention, respectively.
Figure 8:
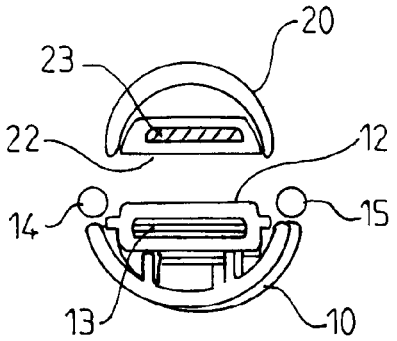

The cylinders are arranged on each side of the first treatment surface 12. As regards the arrangement of possible corresponding shapes facing the two cylinders, three embodiments are illustrated in FIGS. 6, 7, and 8, but they are not limiting to embodiments accessible to a person skilled in the art. According to a first embodiment illustrated in FIG. 6, the second housing 20 has its longitudinal edges 20', 20" arranged on each side of the second treatment surface 22 and facing the cylinders 14, 15 in the closed position. According to a second embodiment illustrated in FIG. 7, the second housing 20 comprises two troughs (24, 25) arranged in each case on each side of the second treatment surface (22) such that, in the closed position, each one holds a cylinder (14, 15). The trough has a shape essentially corresponding to that of the cylinder. According to a third embodiment illustrated in FIG. 8, the second housing 20 covers just the first treatment surface 12.

Several embodiments have been conceived regarding the shape and mobility of the treatment surfaces that will "shape" the lock of hair. A first embodiment is illustrated in FIGS. 1-6; a second embodiment is illustrated in FIGS. 7 and 8. In the first embodiment, the second treatment surface 22 is essentially cylindrical and the first treatment surface 12 has the shape of a concave tile or plate that covers, in the closed position, the second treatment surface 22 along an axis of overlap of 160° to 190°, preferably approximately equal to 180°. The tile can be heated by a heating element 13 inserted in a plate tangential to said tile, forming a single piece for optimizing heat transfer. The second treatment surface 22 is formed by a cylinder attached to the second housing and able to rotate about its longitudinal axis (I) illustrated in FIG. 5. The rotation of this cylinder is free. In the second embodiment, both treatment surfaces (12, 22) are flat straightening surfaces, this embodiment is thus a "standard" straightener containing two freely rotating small rollers or cylinders on each side of one treatment plate only and arranged flush with the flat straightening surface.

The cylinders 14, 15 have a diameter of 3 to 6 mm, preferably of 4 to 5 mm. They can be made of metal, for instance aluminum, or of plastic, for instance a silicone polymer, EPDM (ethylene propylene diene monomer), PPS (polypropylene), etc. The cylinders can be covered with a porous material saturated with a liquid agent, in this case the cylinder is a rod surrounded by a hollow roller of porous material. The liquid agent can be water or a fluid containing a cosmetic with a fixing, coloring, heat protection, or other function. According to the direction of travel of the appliance on the lock, the fluid can be different in each roller of porous material. The cylinders can be detachable, cleanable, or even interchangeable.

DESCRIPTION OF THE OPERATION

In operation, the user thus starts by turning on the appliance, which then controls the heating of the treatment surface or surfaces. An indicator light 33 can show that the heating phase is complete and that the appliance is ready to use. The user takes a lock of hair and inserts the lock, for instance at the root of the latter, between the treatment surfaces and closes the appliance in order to grip the lock statically for several seconds (for instance 3 seconds). The user then pivots the appliance about its longitudinal axis (L) by about a quarter of a turn downwards, and then slides the appliance along the lock until reaching the tip and releasing the lock.

When the rollers are covered with a solid or liquid cosmetic, the contact and possibly also the heat and/or the rubbing on the hair enables an even deposition of the cosmetic.

When the treatment surfaces are a roller facing a tile, the user will then hold the appliance (with the roller facing down and the tile facing up) at the root, which permits a root lift of the lock and the latter to keep this shape for 1 or 2 days.

Obviously the invention is not limited in any way to the embodiments described and illustrated, which were merely given as examples. Modifications are still possible, notably in terms of the constitution of the various elements or by substituting equivalent techniques, without exceeding the scope of protection of the invention in any way.

The invention claimed is:

1. Hairstyling appliance for styling hair, comprising a first housing and a second housing facing the first housing; the housings of longitudinal axis being connected in a pivoting manner by a hinge so as to define an open and closed position of the appliance;

the first housing having a first hair treatment surface, which is intended to be heated by a first heating means;

the second housing having at least one second hair treatment surface, which is intended to come into contact with the first hair treatment surface in order to grip the hair in the closed position;

wherein the appliance contains two cylinders arranged on each side of only the first treatment surface, the cylinders being mounted so as to be able to rotate about their longitudinal axis and being driven in rotation solely by the displacement of the appliance along the hair, wherein the second housing does not contain cylinders on either side of the second hair treatment surface such that the first hair treatment surface and the second hair treatment surface are positioned between the two cylinders when the apparatus is in the closed position to allow a lock of hair to contact one cylinder at a time during operation, wherein the two cylinders are configured to deposit a cosmetic agent on the hair, and wherein the second housing has its longitudinal edges arranged on each side of the second treatment surface and directly opposite the cylinders in the closed position, and wherein the second housing comprises two troughs arranged in each case on each side of the second treatment surface such that, in the closed position, each trough holds a cylinder.

2. Appliance as in claim 1, wherein the two cylinders are mounted so as to be able to rotate freely about their respective longitudinal axis.

3. Appliance as in claim 1, wherein the longitudinal axes of the two cylinders are parallel.

4. Appliance as in claim 1, wherein the second housing covers just the first treatment surface.

5. Appliance as in claim 1, wherein the second treatment surface is essentially cylindrical and wherein the first treatment surface has the shape of a tile which covers, in the closed position, the second treatment surface along an axis of overlap of 160° to 190°.

6. Appliance as in claim 5, wherein the second treatment surface is formed by a third cylinder attached to the second housing and capable of rotating about its longitudinal axis.

7. Appliance as in claim 1, wherein the two treatment surfaces are flat straightening surfaces.

8. Appliance as in claim 1, wherein the cylinders have a diameter of 3 to 6 mm.

9. Appliance as in claim 1, wherein the cylinders are made of metal or plastic.

10. Appliance as in claim 1, wherein the second hair treatment surface is heated by a second heating means.

11. Method for using the appliance as in claim 1, comprising the following steps:

applying the appliance to a root of a lock of hair and gripping it statically for several seconds, then pivoting the appliance about its longitudinal axis by about a quarter of a turn downwards, and then sliding the appliance along the lock to a tip thereof.

12. Appliance as in claim 1, wherein the second treatment surface is essentially cylindrical and wherein the first treatment surface has the shape of a tile which covers, in the closed position, the second treatment surface along an axis of overlap of approximately equal to 180°.

13. Appliance as in claim 1, wherein the cylinders have a diameter of 4 to 5 mm.

14. Appliance as in claim 1, wherein the two cylinders are arranged directly adjacent to said first treatment surface.

15. Appliance as in claim 1, wherein the axis of the two cylinders and each of two edges of the treatment surface that are adjacent to the cylinders are essentially coplanar.

16. Appliance as in claim 1, wherein the two cylinders are covered with a porous material saturated with a liquid cosmetic agent.

17. Appliance as in claim 1, wherein the two cylinders are covered with a solid cosmetic agent.

* * * * *